US012005290B1

(12) United States Patent
Phillips

(10) Patent No.: US 12,005,290 B1
(45) Date of Patent: Jun. 11, 2024

(54) EXERCISE DEVICE FOR COUPLING WEIGHTS TO A USER'S LEG

(71) Applicant: Evan Phillips, Los Angeles, CA (US)

(72) Inventor: Evan Phillips, Los Angeles, CA (US)

( * ) Notice: Subject to any disclaimer, the term of this patent is extended or adjusted under 35 U.S.C. 154(b) by 17 days.

(21) Appl. No.: 18/325,908

(22) Filed: May 30, 2023

Related U.S. Application Data

(60) Provisional application No. 63/465,532, filed on May 11, 2023, provisional application No. 63/475,667, filed on Dec. 5, 2022.

(51) Int. Cl.
*A63B 21/065* (2006.01)
*A63B 21/00* (2006.01)

(52) U.S. Cl.
CPC ..... *A63B 21/065* (2013.01); *A63B 21/4011* (2015.10)

(58) Field of Classification Search
CPC ..... A63B 21/06; A63B 21/065; A63B 21/072; A63B 21/0726; A63B 21/0728; A63B 21/0411; A63B 21/4013; A63B 21/4015; A63B 23/0482; A63B 23/0488
See application file for complete search history.

(56) References Cited

U.S. PATENT DOCUMENTS 5,036,864 A * 8/1991 Yewer, Jr. ..... A41F 9/002 2/338
5,997,494 A * 12/1999 Watkins ..... A61H 1/0218 602/32
9,868,014 B1 1/2018 Lake
10,881,895 B2 1/2021 Gubera
2009/0192025 A1 7/2009 Minerva
2014/0014440 A1* 1/2014 Monnig ..... A63B 27/02 182/221
2014/0194259 A1 7/2014 Alpert
2015/0224382 A1* 8/2015 Hall ..... A63B 69/38 473/450
2020/0114197 A1* 4/2020 McGhee ..... A63B 21/4033
2020/0376316 A1* 12/2020 Shouhed ..... A63B 21/0557

FOREIGN PATENT DOCUMENTS

WO 2004085005 10/2004

OTHER PUBLICATIONS

MonkeyFeet—Animalhouse Fitness; https://animalhousefitness.com/products/monkeyfeet?utm_source=thisiswhyimbroke.com&utm_medium=referral; Accessed on Dec. 30, 2022.

* cited by examiner

*Primary Examiner* — Zachary T Moore
(74) *Attorney, Agent, or Firm* — Concourse Law Group; Katherine B. Sales, Esq.

(57) ABSTRACT

An exercise device comprising a first strap, a second strap, a buckle, and at least one section of padding coupled to an interior surface of the buckle. The first strap has a first end and a second end, and the buckle is fixedly coupled to the first end of the first strap and configured to receive and retain the second of the first strap. The buckle has a base coupled to the first end of the first strap and a handle portion movably coupled to the base by a pin. The second strap has a first end and a second end, wherein the second strap is fixedly coupled to the first strap, the first and second ends of the second strap having hook and loop fasteners coupled thereto and are configured to removably couple to each other. The second strap is configured to grip and retain at least one weight.

14 Claims, 7 Drawing Sheets

EXERCISE DEVICE FOR COUPLING WEIGHTS TO A USER'S LEG

CROSS-REFERENCE TO RELATED APPLICATIONS

This application claims priority to U.S. Provisional Patent Application No. 63/475,667, titled "6-Pack-Strap," filed Dec. 5, 2022, and U.S. Provisional Patent Application No. 63/465,532, titled "6-Pack-Strap," filed May 11, 2023, the contents of which are incorporated by reference herein in their entirety.

BACKGROUND

Physical exercise is an important part of a healthy lifestyle. In recent years, it has become popular to exercise at home, or outside the gym. However, exercising outside the gym has the disadvantage of limited to access to traditional gym equipment.

Accordingly, there is a need for an exercise device that aids users in exercising without the need for more traditional gym equipment.

SUMMARY

The present invention addresses this need. The present invention is directed to an exercise device a p sing a first strap having a first end and a second end, a buckle fixedly coupled to the first end of the first strap and configured to receive and retain the second of the first strap, and a second strap having a first end and a second end, wherein the second strap is fixedly coupled to the first strap. The first and second ends of the second strap are configured to removably couple to each other, and the second end of the first strap is configured to slide into and be retained by the buckle. Optionally the device also comprises at least one spacer.

Optionally, the first strap and the second strap each have a longitudinal axis, and the longitudinal axis of the first strap is perpendicular to the longitudinal axis of the second strap.

Optionally, the buckle comprises a base coupled to the first end of the first strap, and a handle portion movably coupled to the base by a pin.

Optionally, the first and second ends of the second strap have hook and loop fasteners coupled thereto, and the first and second ends of the second strap are configured to removably couple to each using the hook and loop fasteners.

Optionally, the device further comprises at least one section of padding coupled to an interior surface of the buckle.

A method of using the exercise device comprises the steps of a) providing the exercise device, b) securing at least one weight to the device using the second strap, c) optionally positioning the at least one spacer between the user's legs, d) securing the first strap to at least a portion of one of the user's legs, and d) lifting at least one of the user's legs.

Optionally, step c) is performed before step b).

DRAWINGS

These and other features, aspects, and advantages of the present invention will become better understood with regard to the following description, appended claims, and accompanying drawings.

DESCRIPTION

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

Figure 1:
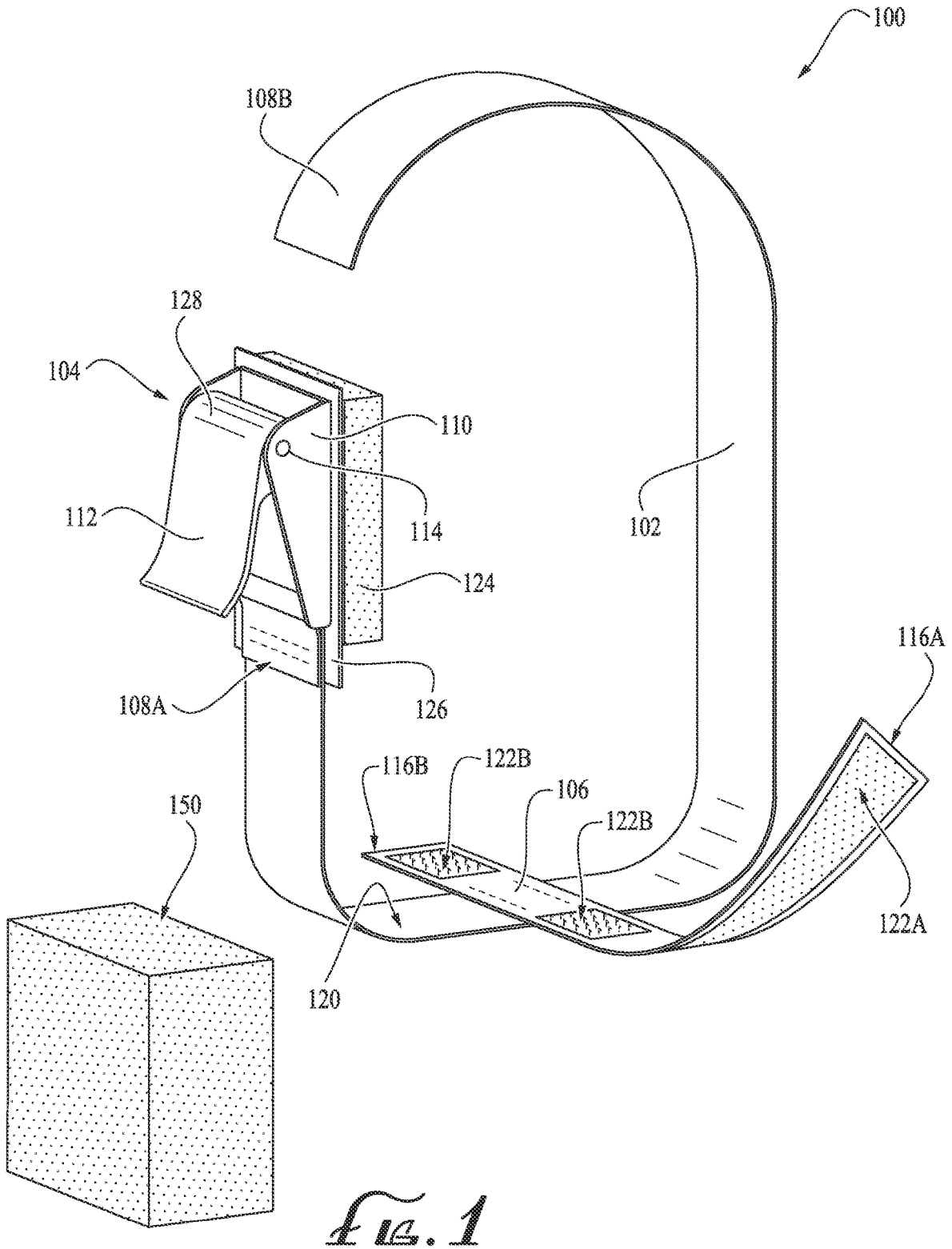
FIG. 1 is a front perspective view of an exercise device having features of the present invention.
Figure 2:
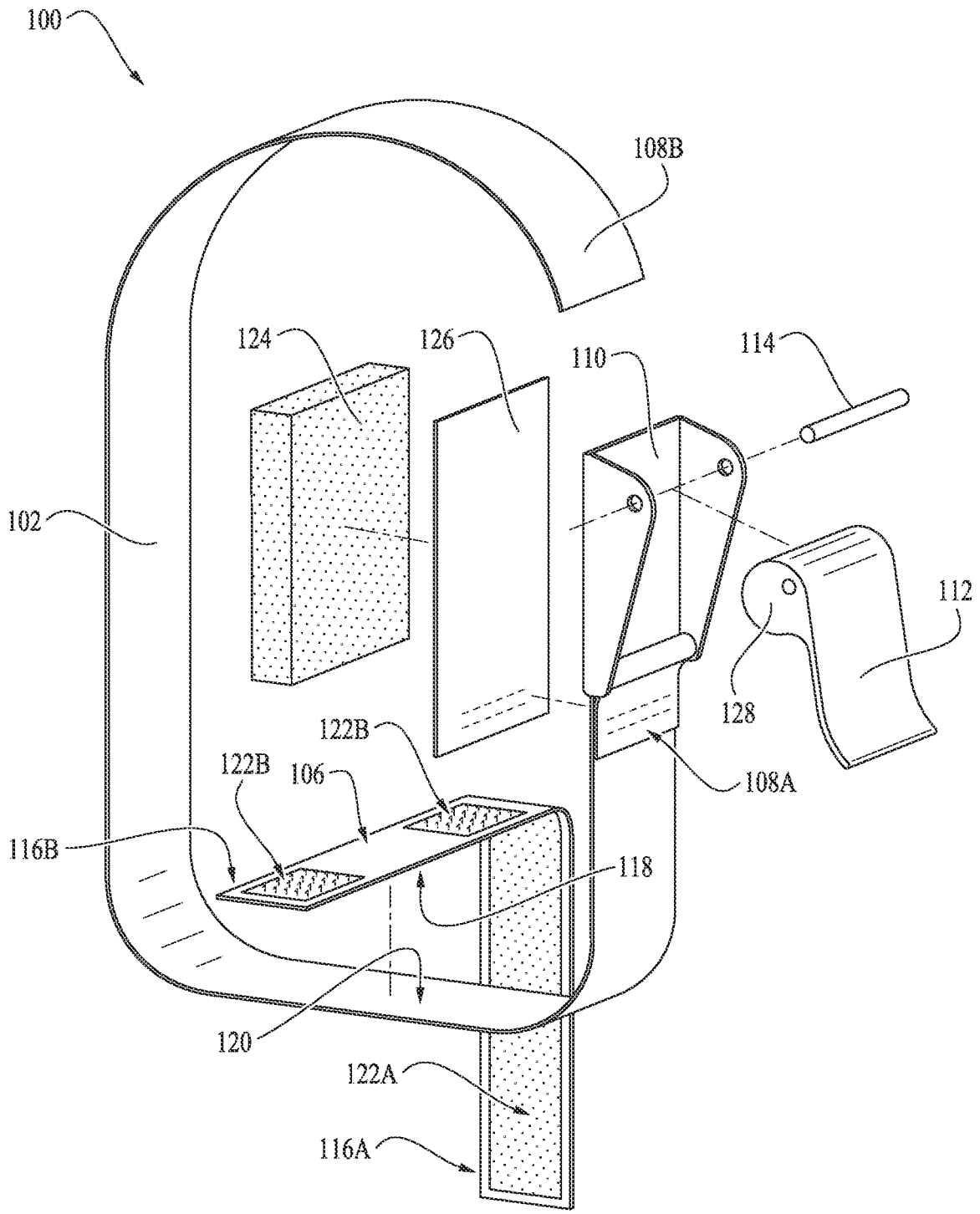
FIG. 2 is a front, exploded perspective view of the exercise device of FIG. 1.

Referring now to FIGS. 1 and 2, there is shown an exercise device 100 having features of the present invention.

The exercise device 100 has a first strap 102, a buckle 104, and a second strap 106. The first strap 102 has two opposed ends, a first end 108A and a second end 108B, and a longitudinal axis that extends along the length of the strap 102, from the first end 108A to the second end 108B. Optionally, the device 100 can be used with at least one spacer 150.

The buckle 104 has a base 110, a movable handle portion 112, and a pin 114 that movably secures the handle portion 112 to the base 110. The buckle 104 is configured to receive and securely retain the second end 108B of the first strap 102. The base 110 is fixedly coupled to the first end 108A of the first strap 102, which is looped through a portion of the base 110 and fixedly coupled to itself via stitching or some other permanent and secure method. The first end 108A of the first strap 102 that is looped through the base 110 is also fixedly coupled to a portion of strap 126. Coupled to the portion of strap 126 is at least one section of padding 124, that is discussed in great detail below. This configuration can be best seen in FIG. 2.

The second strap 106 has two opposed ends, a first end 116A and a second end 116B, and a longitudinal axis that extends along the length of the strap 106, from the first end 116A to the second end 116B. An interior surface 118 of the second strap 106 is fixedly coupled to an interior surface 120 of the first strap 102 and preferably, although not necessarily, the longitudinal axis of the first strap 102 is perpendicular to the longitudinal axis of the second strap 106, and vice versa. The first and second ends 116A, 116B of the second strap 106 can have hook and loop fasteners 122 coupled thereto. Optionally, an external surface of the first strap 116A has a half of the hook and loop fasteners 122A coupled thereto, and an interior surface of the second end 116B has the other half the hook and loop fasteners 122B coupled thereto.

Optionally, the ends of the second strap 116A, 116B can utilize some other type of removable fastening system to removably couple the ends of the second strap 116A, 116B to themselves. The other types of fastening systems can comprise snaps or a buckle or ratchet system.

The second strap 106 is configured to grip and retain at least one weight 300. The weight 300 can be a dumbbell, as shown in the figures, or some other type/form of weight that can be used to achieve the same exercise result. The first and second ends 116A, 116B of the second strap 106 are configured to removably couple to each other using hook and loop fasteners 122A, 122B.

Optionally, there is more than one first strap 102 and/or more than one second strap 106 (not show). More than one first strap 102 increase the gripping ability of the device 100 to grip to a user and allow the device 100 to hold more weight. More than one second strap 106 allows the used to couple more than one weight to the first strap 102, increasing the lifting capacity of the device 100.

Optionally, but preferably, there is at least one section of padding 124 coupled to an interior surface of the section of strap 126. The padding 124 provides comfort to the user 500 when the device 100 is strapped securely to a portion of at least one of their legs.

Figure 4:
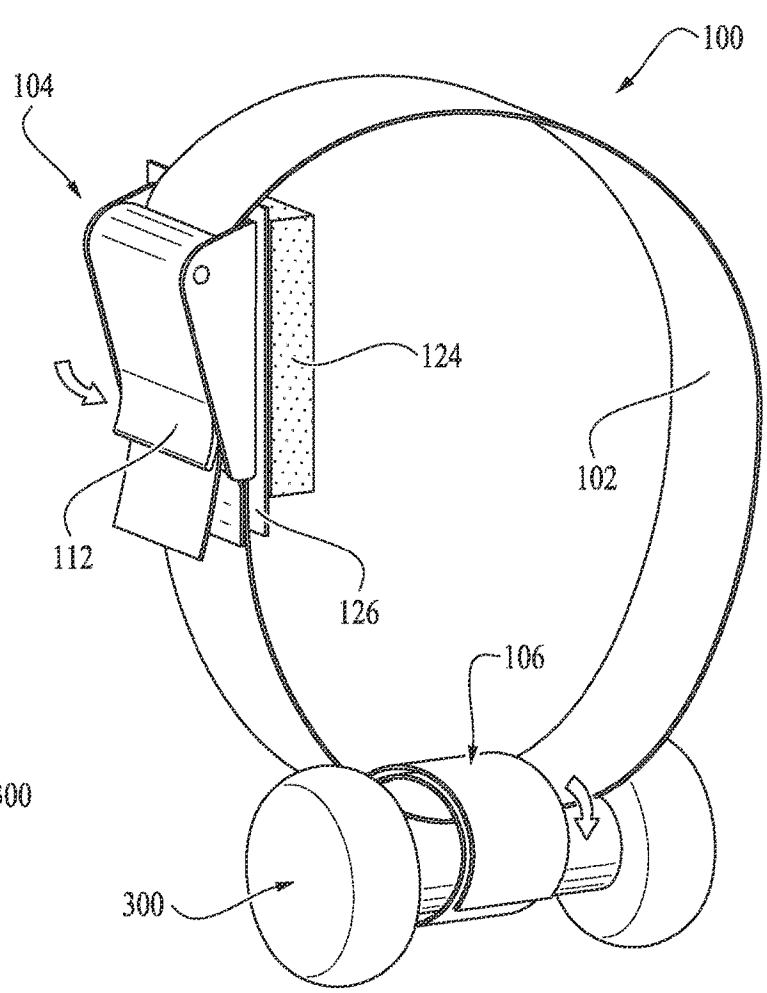
FIG. 4 is another front perspective view of the method of using the device of the FIG. 3, wherein the handle portion of the buckle is pressed downward, securing the end of the first strap therein, and the second strap has secured the at least one weight to the device.
Figure 3:
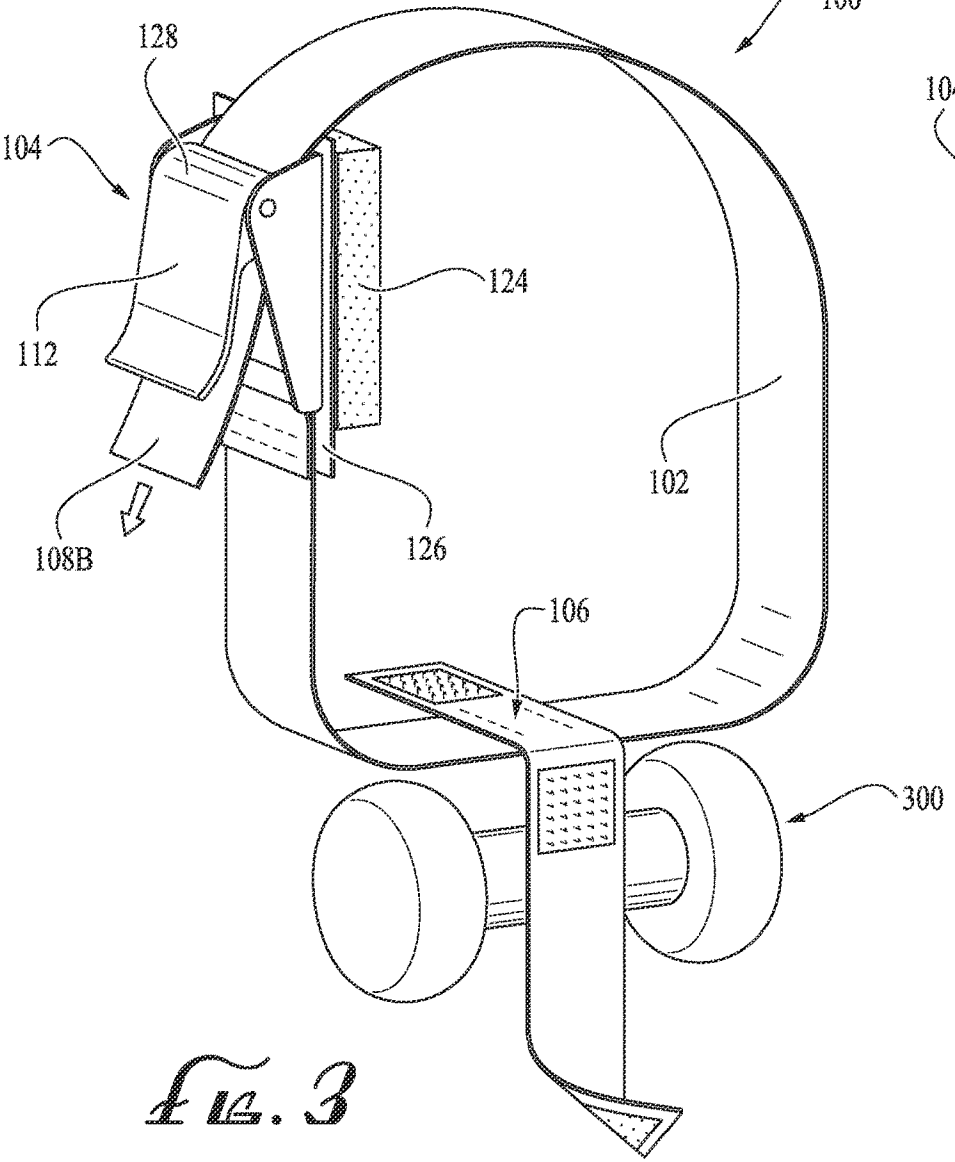
FIG. 3 is a front perspective view of a method of using the exercise device of FIG. 1, wherein a handle portion of a buckle has been lifted, and an end of a first strap has been inserted into the buckle, and, at least one weight is positioned for coupling to the device by a second strap.

Referring now to FIGS. 3 and 4, the function of the buckle 104 and the gripping of the weight 300 by the second strap 106 are shown. FIG. 3 shows the handle portion 112 of the buckle 104 in an open, receiving position, where the handle 112 is pivoted upwards, away from the base 110, allowing the second end 108B of the first strap 102 to be slid through the open space between the handle 112 and the base 110. Additionally, the second strap 106 is an open, receiving position wherein its two ends 116A, 116B are not coupled to each other, and the weight 300 can be inserted therebetween.

FIG. 4 shows the handle 112 in a closed, locked position, wherein the handle 112 is pivoted downwards, towards the base 110, securing the second end 108B of the first strap 102 therein. Pressure and gripping force are applied by the gripping portion 128 of the handle 112 to the second end 108B of the strap, pinning the strap 108B between the gripping portion 128 of the handle 112 and the base 110 of the buckle 104. Additionally, the second strap 106 is now in a closed, retaining position, wherein its two ends 116A, 116E are coupled to each other and the weight 300 is securely retained therein.

The buckle 104 is not limited to the specific shape and configuration shown in the figures. The buckle 104 can have a different configuration, and any type of locking buckle that could be used in this device 100 that would allow the user to secure the first strap 102 tightly around at least a portion of one of their legs. Optionally, the buckle 104 can be a ratchet system.

Figure 5:
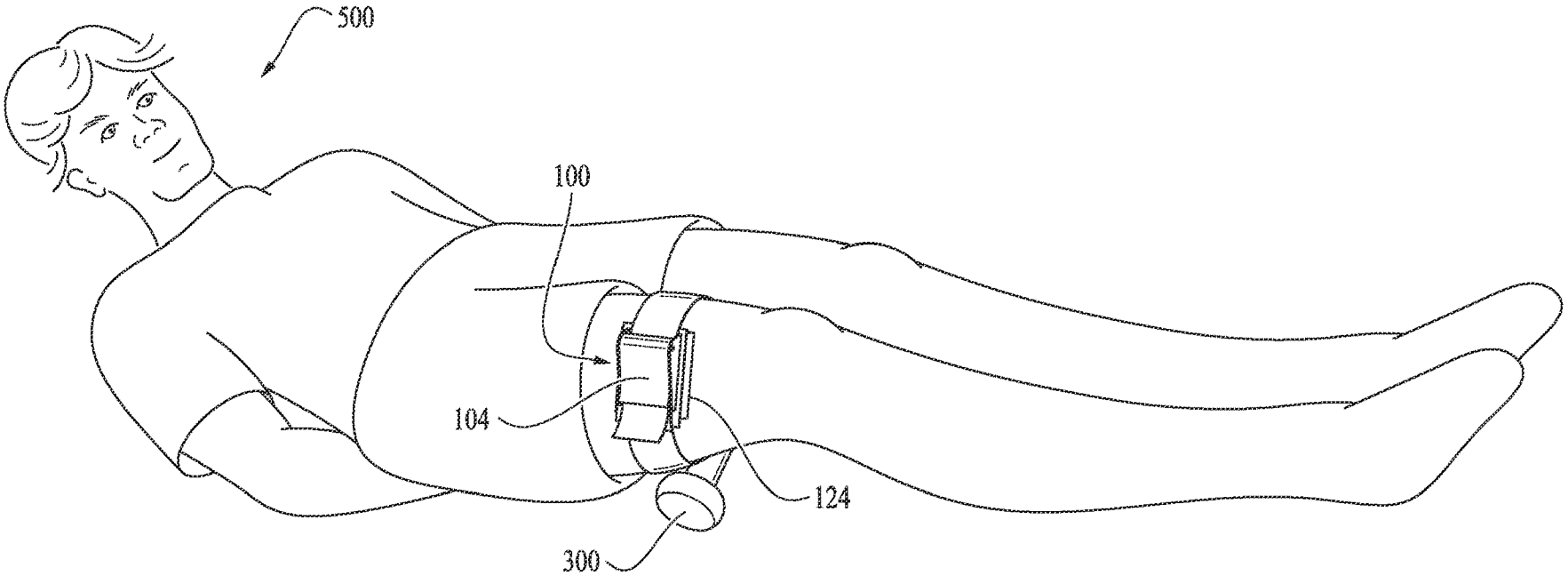
FIG. 5 is a perspective view of a first step of one method of a user using the device of FIG. 1, wherein the device is secured to an upper portion of the user's leg.
Figure 6:
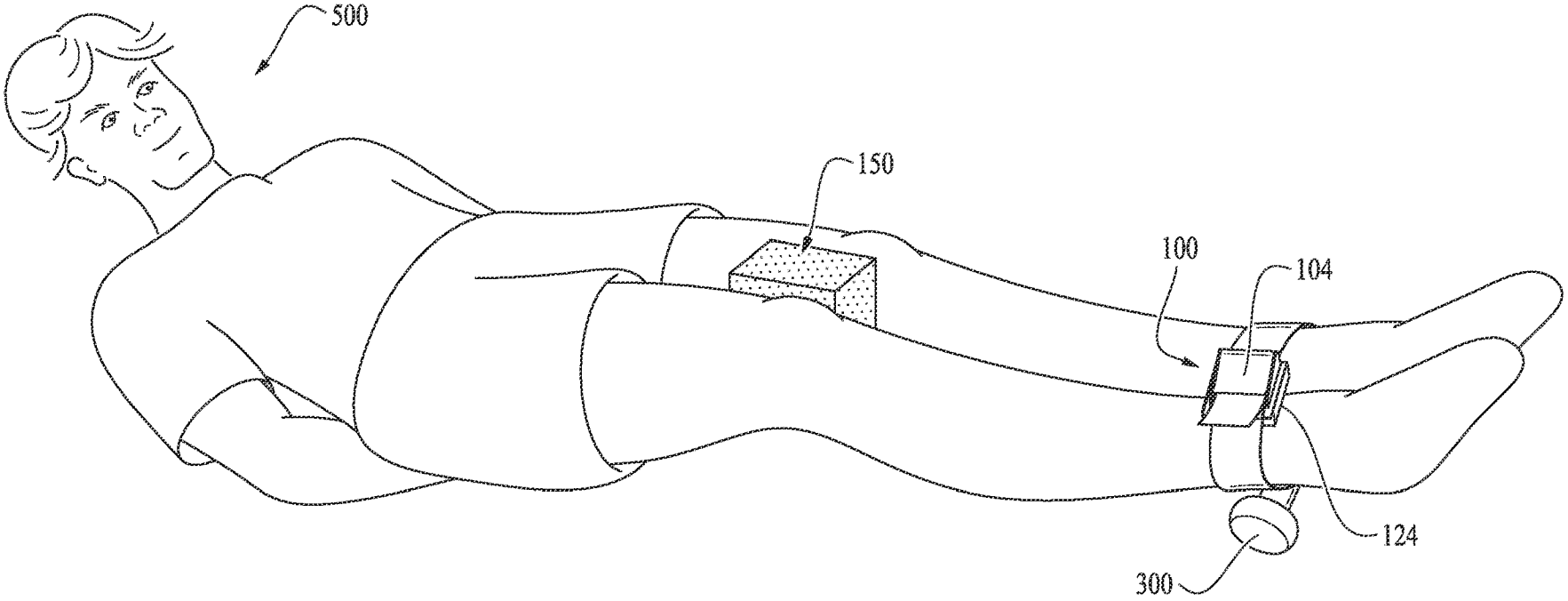
FIG. 6 is a perspective view of a first step of a second method of a user using the device of FIG. 1, wherein the device is secured to a lower portion of the user's leg.
Figure 7:
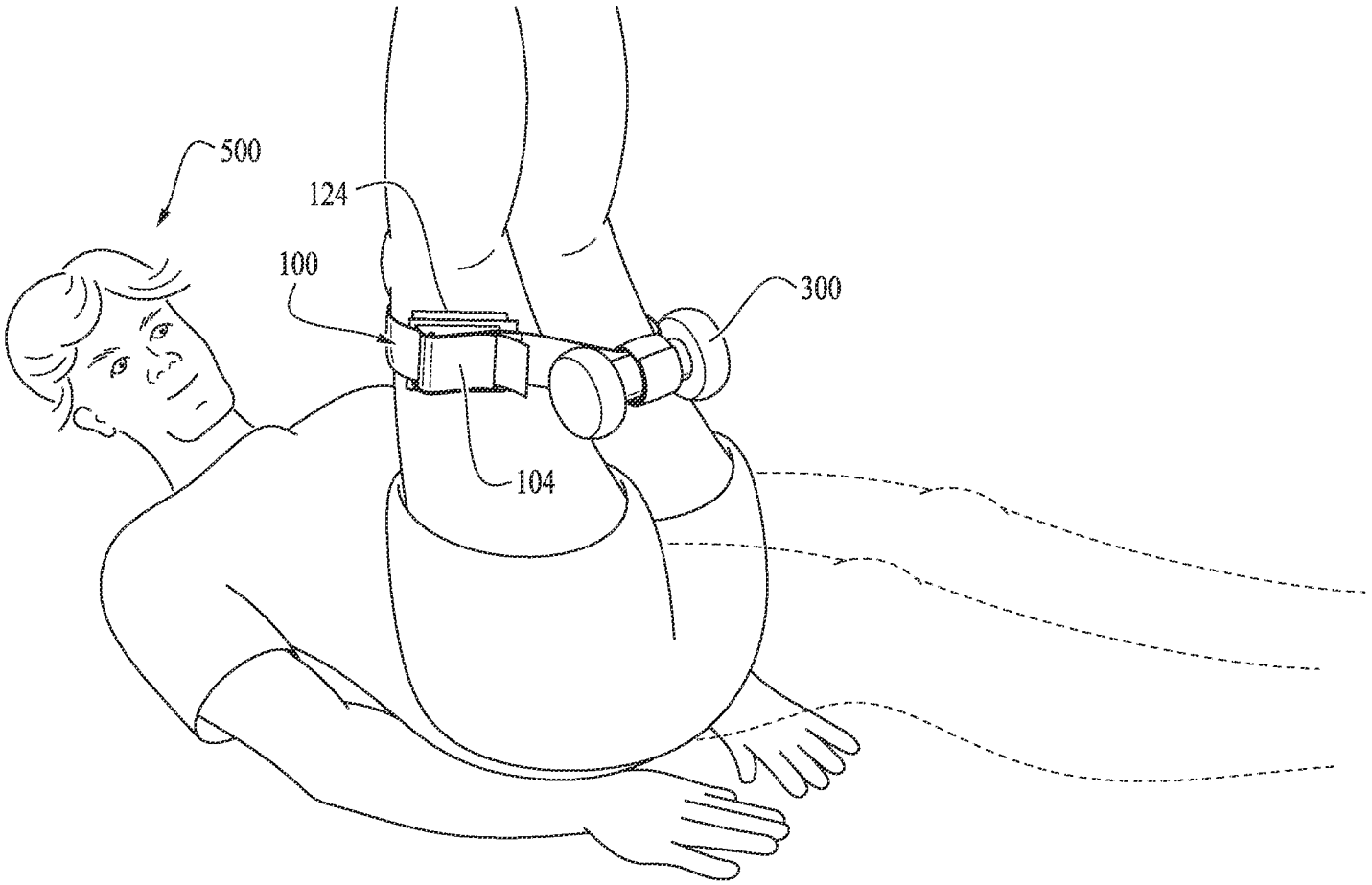
FIG. 7 is a perspective of the second step of either the first or second method of FIGS. 5 and 6, wherein the user lifts their leg to exercise.
Figure 9:
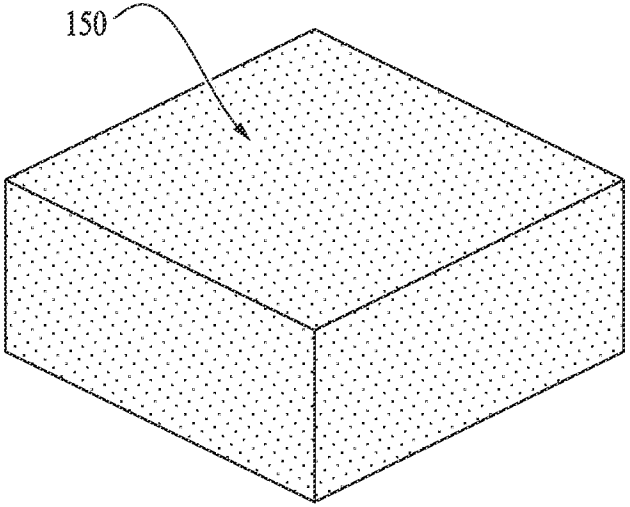
FIG. 9 is a perspective view of the spacer.

Referring now to FIGS. 5 through 7, there is shown use of the device 100 in greater detail. A user 500 lays on the ground, or other flat surface, straps the weight 300 to the device 100 as shown in FIGS. 3 and 4, and then secures the device 100 to a leg portion using the first strap 102 and the buckle 104. As shown in FIG. 5, the device 100 can be secured to at least one thigh portion of the user 500. Alternatively, as shown in FIG. 6, the device 100 can be secured to at least one ankle portion of the user 500. As shown in FIG. 6, the device 100 is secured to both ankles of the user 500. It should be noted that the device 100 can be secured anywhere along at least one leg, or both legs, of the user 500. Optionally, a device 100 can be secured to each leg of the user 500. Optionally, more than one device 100 can be secured to a leg portion of the user 500.

Figure 8:
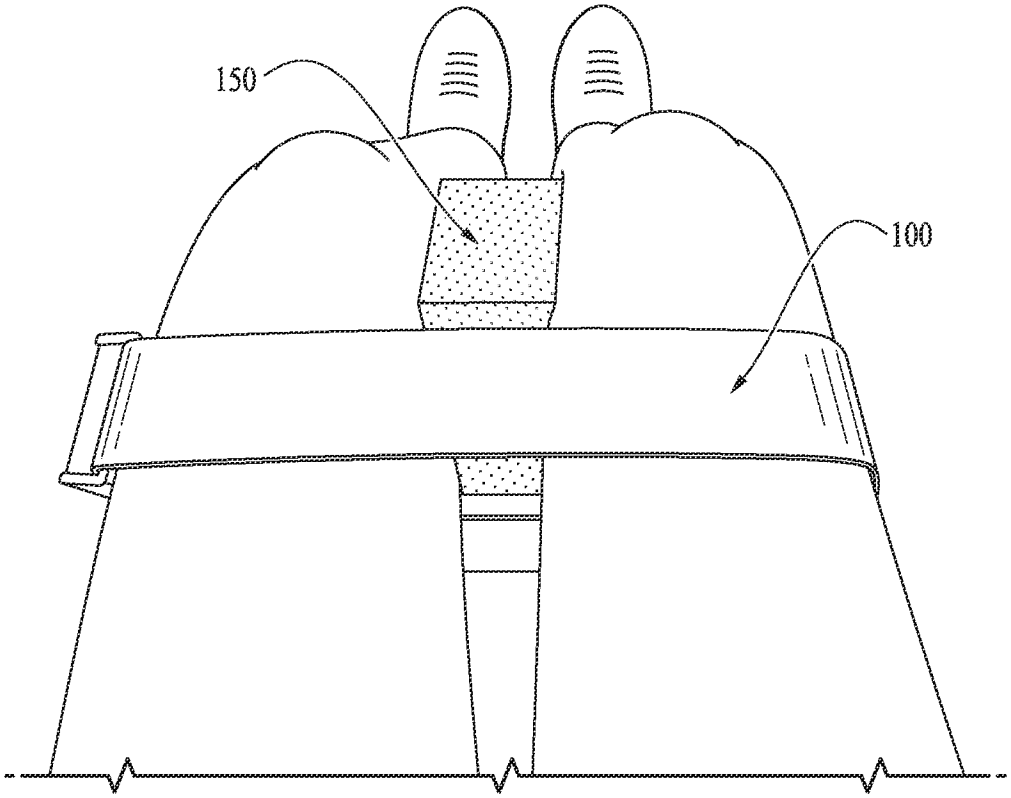
FIG. 8 is top perspective view of a user using the device.

Optionally, at least one spacer 150 can be placed between the user's legs, anywhere along the length of user's legs, as shown in FIGS. 6 and 8. The spacer 150 functions as a cushioned spacer between the user's legs to increase the comfort level when using the device 100 as the user's knees are not pressing directly against each other. Additionally, the spacer 150 allows the user to comfortably apply inward pressure between their legs, such as by squeezing their legs together, which can increase the effectiveness of the exercise device 100 and allow the user to better engage their various core muscles. The spacer 150 can be made from any material that permits at least some slight compression so that it is comfortable for user to grip and squeeze between their legs. Preferably the spacer 150 is made from a foam material. The spacer 150 can be any shape and is not limited to the rectangular/cuboid shape shown in the figures. Optionally, the spacer 150 can have opposed side surfaces that are concave to form a slight recess for retaining each of the user's legs, or the spacer 150 can be spherical in shape.

Once one or more devices 100 are secured to the user's legs 500, and/or the optional at least one spacer 150 is properly positioned between the user's legs, the user 500 then lifts their leg (or legs), pivoting at their hips, to performed a weighted leg exercise that works their core and abdominal region. This pivoting/leg lifting/leg lowering movement is shown in FIG. 7, and the leg(s) are lifted and lowered as many times as desired by the user 500.

Optionally, the device 100 is secured to the user's 500 leg first, and then the weight 300 is secured to the device 100 using the second strap 106. Once the weight 300 is coupled to the device 100, the user 500 then performs the lifting/lowering leg movement shown in FIG. 7.

The straps 102, 106 of the device 100 can be made from any sturdy strap material such as nylon, vinyl, cotton, or composite material. Preferably, the straps 102, 106 are made from nylon. The straps 102, 106 can be any width and length that can reasonably be utilized in this fashion. Preferably, the straps 102, 106 are 2 inches wide and 40 inches long.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference.

What is claimed is:

1. An exercise device comprising:

a) a first strap having a first end, a second end, and a longitudinal axis;

b) a buckle fixedly coupled to the first end of the first strap and configured to receive and retain the second end of the first strap, the buckle having:
i) a base coupled to the first end of the first strap; and
ii) a handle portion movably coupled to the base by a pin;
c) a second strap having a first end, a second end, and a longitudinal axis, wherein the second strap is fixedly coupled to the first strap and the longitudinal axis of the second strap is perpendicular to the longitudinal axis of the first strap, the first and second ends of the second strap having hook and loop fasteners coupled thereto;
d) at least one section of padding coupled to an interior surface of the buckle; and
e) at least one spacer;
wherein the second end of the first strap is configured to slide into and be retained by the buckle;
wherein the second strap is configured to grip and retain at least one weight, and the first and second ends of the second strap are configured to removably couple to each other using the hook and loop fasteners.

2. A method of using the device of claim 1, the method comprising:
a) providing the device of claim 1;
b) securing the at least one weight to the device using the second strap;
c) positioning the at least one spacer between a user's legs;
d) securing the first strap to a portion of at least one of the user's legs; and
e) lifting at least one of the user's legs.

3. The method of claim 2, wherein step c) is performed before step b).

4. An exercise device comprising:
a) a first strap having a first end and a second end;
b) a buckle fixedly coupled to the first end of the first strap and configured to receive and retain the second end of the first strap;
c) a second strap having a first end and a second end, wherein the second strap is fixedly coupled to the first strap, the first and second ends of the second strap configured to removably couple to each other; and
d) at least one section of padding coupled to an interior surface of the buckle;
wherein the second end of the first strap is configured to slide into and be retained by the buckle.

5. The device of claim 4, wherein the first strap has a longitudinal axis and the second strap has a longitudinal axis, and the longitudinal axis of the second strap is perpendicular to the longitudinal axis of the first strap.

6. The device of claim 4, wherein the buckle comprises:
a) a base coupled to the first end of the first strap; and
b) a handle portion movably coupled to the base by a pin.

7. The device of claim 4, wherein the first and second ends of the second strap have hook and loop fasteners coupled thereto, and the first and second ends of the second strap are configured to removably couple to each other using the hook and loop fasteners.

8. The device of claim 4, further comprising at least one spacer.

9. A method of using the device of claim 8, the method comprising:
a) providing the device of claim 8;
b) securing the at least one weight to the device using the second strap;
c) securing the first strap to a leg portion of a user; and
d) lifting the leg portion of the user.

10. The method of claim 9, wherein step c) is performed before step b).

11. A method of using the device of claim 4, the method comprising:
a) providing the device of claim 4;
b) securing the at least one weight to the device using the second strap;
c) securing the first strap to a leg portion of a user; and
d) lifting the leg portion of the user.

12. The method of claim 11, wherein step c) is performed before step b).

13. An exercise device comprising:
a) a first strap having a first end and a second end;
b) a buckle fixedly coupled to the first end of the first strap and configured to receive and retain the second end of the first strap;
c) a second strap having a first end and a second end, wherein the second strap is fixedly coupled to the first strap, the first and second ends of the second strap configured to removably couple to each other;
d) at least one section of padding coupled to an interior surface of the buckle;
wherein the second end of the first strap is configured to slide into and be retained by the buckle; and
and the first and second ends of the second strap are configured to removably couple to each other using a hook and loop fasteners.

14. The device of claim 13, further comprising at least one spacer.

* * * * *